United States Patent [19]

Adams

[11] 4,412,795

[45] Nov. 1, 1983

[54] VANE TYPE FLUID MOTOR MANIFOLD

[75] Inventor: Frank Adams, Waubaushene, Canada

[73] Assignee: Dresser Industries, Inc., Dallas, Tex.

[21] Appl. No.: 212,551

[22] Filed: Dec. 4, 1980

[51] Int. Cl.[3] ..... F03C 2/00; F03C 4/00

[52] U.S. Cl. ..... 418/86; 418/270; 418/15

[58] Field of Search ..... 418/86, 270, 15

[56] References Cited

U.S. PATENT DOCUMENTS

| | | | |
|---|---|---|---|
| 120,231 | 10/1871 | Barriger | 418/270 |
| 159,066 | 1/1875 | Beekman | 418/270 |
| 212,463 | 2/1879 | Haughey | 418/270 |
| 651,616 | 6/1900 | Thormeyer | 418/270 |
| 832,479 | 10/1906 | Hendrickson | 418/270 |
| 1,031,765 | 7/1912 | Wright | 418/270 |
| 2,321,190 | 6/1943 | Ellinwood | 103/136 |
| 2,504,841 | 4/1950 | Jones | 230/45 |
| 3,043,274 | 7/1962 | Quackenbush | 418/236 |
| 3,295,262 | 1/1967 | Brown | 418/270 |

*Primary Examiner*—Ronald B. Cox
*Attorney, Agent, or Firm*—Richard M. Byron

[57] ABSTRACT

A rotary fluid motor with an internal liner has an internal manifold system within the casing and liner which provides not only separations for the fluid involved, but cooling fins and a structural support for the liner. The function of the internal manifold is to provide cooling fins which is important for adequate cooling of the motor during operating.

11 Claims, 3 Drawing Figures

VANE TYPE FLUID MOTOR MANIFOLD

TECHNICAL FIELD

The invention relates to fluid rotary motors such as compressed air motors.

BACKGROUND OF THE INVENTION

Most conventional fluid motors have external manifolds to deliver propulsion fluid to the motor and exhaust fluid from the motor; and, a few have been constructed with internal channels for directing fluid to the rotor chambers.

SUMMARY OF THE INVENTION

This invention combines the known vaned rotor and housing of rotary fluid motors with an internal liner and an internal manifold system within the housing which provides not only separations for the fluids involved, but cooling fins and a structural support for the liner. The function of the internal manifold is to provide cooling fins which is important for adequate cooling of the motor when operating.

BRIEF DESCRIPTION OF THE DRAWING

The foregoing advantage of the invention will become more apparent as the following detailed description is read in conjunction with the accompanying drawing wherein like reference characters denote like parts in all views and wherein.

DESCRIPTION OF THE PREFERRED EMBODIMENT

Figure 1:
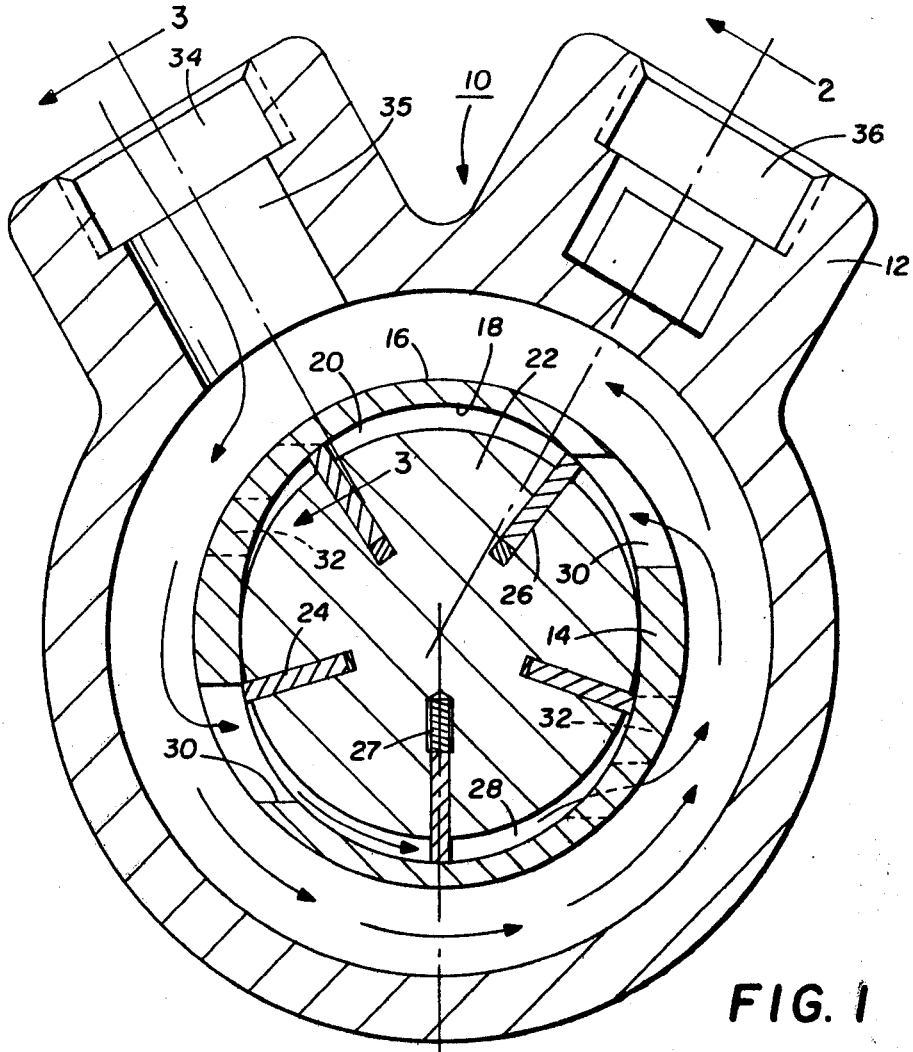
FIG. 1 is a side elevation view of a fluid air motor constructed in accordance with the invention.
Figure 3:
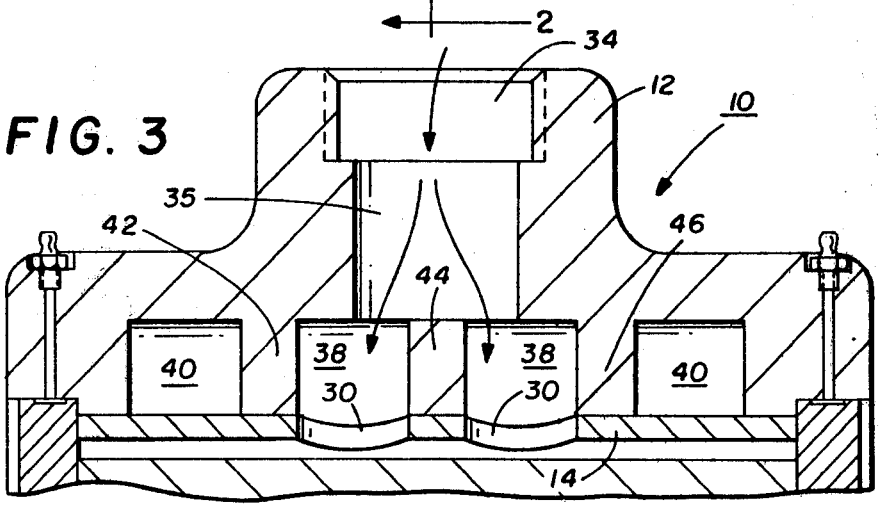
FIG. 3 is a partial transverse sectional elevation of the motor taken along line 3—3 of FIG. 1.
Figure 2:
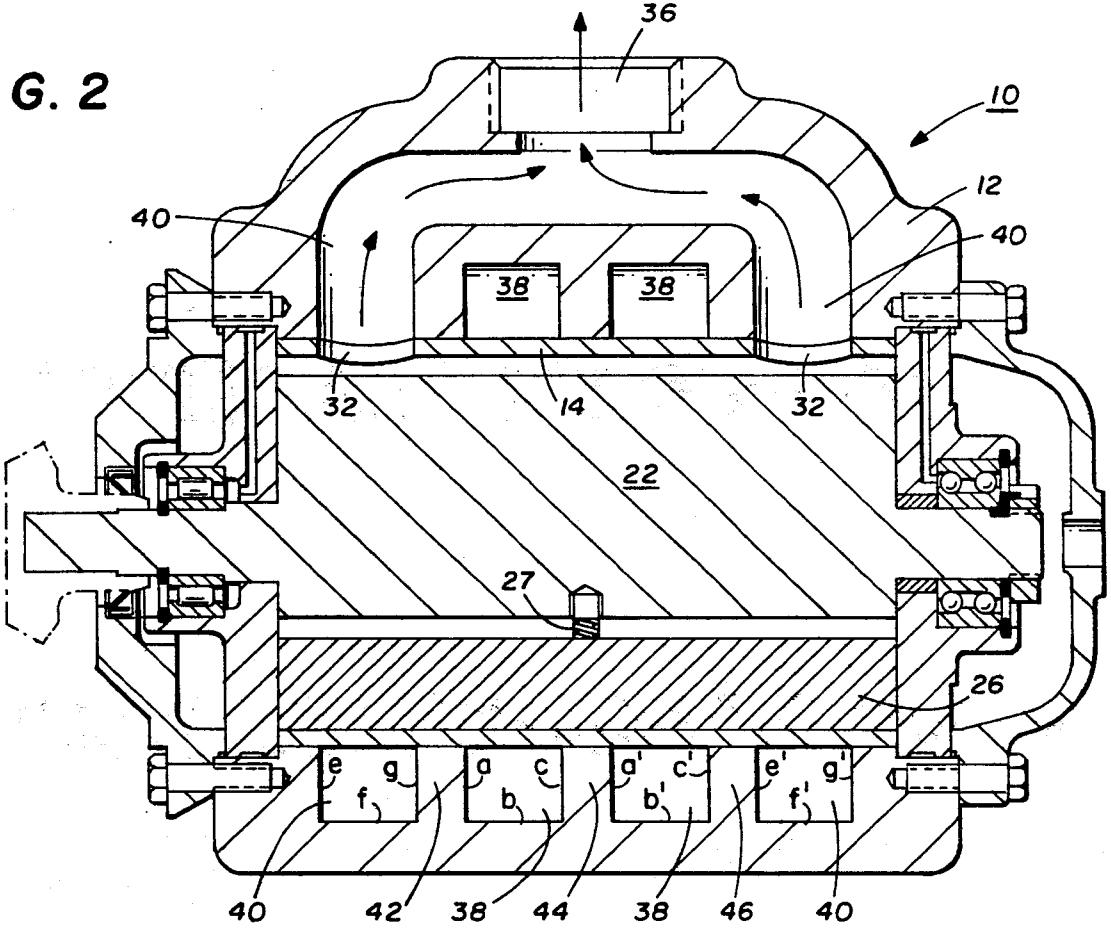
FIG. 2 is a transverse sectional elevation of the motor taken along line 2—2 of FIG. 1.

Referring to the drawing and to FIGS. 1, 2 and 3 in combination, shown therein and generally designated by the reference character 10 is a fluid air motor constructed in accordance with the invention. The motor 10 has a housing 12 with a bore therein. A generally cylindrical liner 14 is positioned within housing 12 which has a circular outer periphery 16 engaging the inner peripheral portion of the housing 12 and an elliptical inner periphery 18 forming a rotor cavity 20 in which a rotor 22 is operably mounted.

The rotor 22 is provided with a plurality of a longitudinally extending slots 24 extending radially of the rotor's axis and it has a plurality of blades 26 mounted in the slots 24. Springs 27 located at the base of slots 24 urge the blades outwardly against the liner so the chambers are substantially sealed for starting. As shown in FIG. 1, the blades 26 with the rotor 22 and the elliptical inner periphery 18 of the liner 14 define two cross-sectionally crescent shaped segments 28 which is transverse to the rotor 22 and the rotor cavity 20. These cresent shaped segments 28 extend through the rotor cavity 20 longitudinally of the rotor axis forming expansion chambers within the rotor cavity 20 between the blades 26. With this arrangement each rotor blade 26 will move radially outwardly relative to the rotor 22 as it passes through the crescent shaped segments 28 of the chamber and they will move radially into the rotor 22 for movement past the portions of the rotor cavity 20 joining the segments 28. Each of the crescent shaped segments 28 will have an inlet opening 30 and an outlet opening 31. The direction of fluid flow through these passageways is indicated by arrows on the figures.

The interior of the air motor housing 12 immediately outward of the liner 14 has two separate annular manifolds: an inlet air manifold and an outlet air manifold. The inlet air manifold has an inlet port 34 from the exterior of the motor housing and a passageway 35 therefrom to a pair of annular inlet chambers 38 around the exterior of the liner 14 with the chambers 38 being positioned in a spaced relation.

The outlet manifold includes an outlet port 36 through the exterior of the rotor housing 12 that communicates through a second passageway 37 with a second pair of annular chambers 40 around the exterior of the liner 14 with these second annular chambers 40 being disposed in a spaced relation to each other and to the annular inlet chambers 38 of the inlet manifold.

The liner 14 also forms a portion of the inlet and outlet manifolds in that it contains inlet and outlet openings 30 and 31 from each of the chambers 38 and 40 thereby providing communication from these chambers to the interior of the liner 14. These openings 30 and 31 are appropriately positioned at opposed end portions of the crescent shaped rotor chamber segments 28. These openings 30 and 31 are positioned such that each crescent shaped rotor chamber segment 28 will have at least one inlet and at least one outlet.

Referring to FIG. 2, the annular chambers 38 and 40 define a plurality of walls 42, 44, and 46 integrally formed with the housing 12 that extend in a transverse relation to the longitudinal axis of the rotor forming the internal manifold as described herein above. These walls 42, 44, and 46 support the liner on their inner surface, and not only provide separations for the fluids involved, but cooling fins and a structural support for the liner 14.

In operation of this motor, the propulsion fluid follows a path through the motor 10 as shown by the arrows in all figures of the drawing. The fluid entering through the inlet port 34 and passageway 35 circles through annular chambers 38 and into the inlet openings 30 of the liner 14 thus passing into the expansion chamber of the rotor cavity 20. The propulsion fluid leaves the expansion chamber via the outlet openings 32 in the liner 14 circling the outlet annular chambers 40 and exhausting through the outlet passageway 37 and outlet port 36.

As the propulsion fluid circumscribes the rotor chamber through chambers 38 and 40, it provides a medium for heat exchange from the multisurfaces defined by housing 12 and the walls 42, 44, and 46 thereby keeping the motor considerably cooler than a fluid motor of conventional construction. When the propulsion fluid which is cooler than the operating motor, circulates in annular chambers 38, heat is exchanged from surfaces a, b, c, a′, b′, and c′ to the fluid; and, as exhausting fluid circulates in annular chambers 40, heat is additionally exchanged from the motor housing from surfaces e, f, g, e′ f′, and g′ to the fluid and exhausted, thereby cooling the motor. The function of these walls in providing cooling fins is important for adequate cooling of the motor during operation.

In other embodiments of this invention, any number of these crescent shaped segments can be formed within the rotor cavity to provide multiple chamber operation of the air motor. When a plurality of such segments are used in an air motor, the rotor is centrally positioned within the rotor cavity and each of the segments are positioned around the rotor in an equal-circumferential relationship. The power that such an air motor can develop will depend to some extent on the number of these crescent shaped segments within the rotor cavity because this determines the number of cycles the motor can have for one rotation.

Preferred construction of this air motor uses an odd multiple of blades, 3, 5, 7, etc. to ensure self starting. This arrangement positions the the blades so that that a pair of blades will always be located on opposite sides of either an exhaust or inlet port. Because the rotor blades are at a location which will prevent fluid flow from the inlet to the outlet without causing the rotor to be rotationally displaced, it will be prevented from stalling due to the position of the rotor. Additionally, utilizing this odd multiple number of rotor blades provides for less vibration of the motor during operation because the blades are arranged such that during rotation of the rotor it will always have some blades positioned to accept air into a segment of the rotor chamber from the inlet while other blades positioned to discharge air from another such segment to the exhaust.

EXAMPLE

A prototype air motor has been constructed with seven blades and two segments in the rotor cavity substantially as shown in the drawing. The 5-bladed motor with two inlet chambers and two outlet chambers had about 57 horsepower at about 2000 rpm. The motor runs cold to the touch on the outside of housing 12. Tests indicate that the motor runs substantially cooler than an air motor of about two-thirds the size (approximately 36 horsepower). Since the motor runs cooler, it is less likely to overheat; hence, it should have a longer life span.

The embodiments described in detail hereinbefore, are provided by way of example only and it will be understood that any changes and modifications can be made thereto without departing from the spirit or scope of the invention.

The embodiments of the invention in which an exclusive property or privilege is claimed are defined as follows:

1. In a fluid motor having a housing with a bore therein, a liner within the bore, a rotor rotatably operably mounted in the housing and liner combination, the rotor being provided with a plurality of radially extending slots, and a blade mounted in each of the slots, the blades defining with the rotor and the liner a sealed chamber, inlet and outlet openings in the liner, the improvement comprising:

an inlet manifold having an inlet passageway from the exterior of the housing and communicating with two annular inlet chambers, each extending around the exterior of the liner with said chamber in communication with a liner inlet opening to pass fluid from the inlet to the interior of the liner;

an outlet manifold having an exhaust outlet passageway through the rotor housing communicating with two annular outlet chambers, each extending around the exterior of the liner with said annular outlet chamber being in communication with a liner opening to pass exhaust fluid from the interior of the liner to said exhaust outlet passageway; and said annular inlet chambers and said annular outlet chambers each extending completely around said liner and each being defined between walls of said housing extending transverse to said liner and an internal housing surface facing said liner, wherein said walls provide for heat exchange between said liner and said housing and for heat exchange between inlet and exhaust fluids circulating through said inlet and outlet chambers.

2. The fluid air motor of claim 1 wherein said inlet manifold is located in a mid-portion of the rotor and said outlet manifold is located on the end portion of the rotor.

3. A fluid motor having a housing with a bore therein, a liner within the bore, a rotor rotatably operably mounted in the housing and liner combination, the rotor being provided with a plurality of radially extending slots, and a blade mounted in each of the slots, the blades defining with the rotor and the liner a sealed chamber, inlet and outlet openings in the liner, the improvement being an internal manifold comprising:

an inlet manifold inside the housing having an inlet passageway from the exterior of the housing and communicating with a pair of annular inlet chambers around the exterior of the liner with said chambers being positioned in a spaced relation to each other in communication with a liner inlet opening to pass fluid from the inlet to the interior of the liner; and an outlet manifold inside the housing having an exhaust outlet passageway through the rotor housing communicating with a pair of annular outlet chambers around the exterior of the liner with said annular outlet chambers being disposed in a spaced relation to each other and to said annular inlet chambers and being in communication with a liner opening to pass exhaust fluid from the interior of the liner to said exhaust outlet passageway.

4. The fluid air motor of claim 1 wherein said inlet manifold is located in a mid-portion of the rotor and said outlet manifold is located on the opposed end portions of the rotor.

5. The fluid air motor of claims 1 or 2 wherein the annular inlet chambers and annular outlet chambers are defined by walls within the housing which provide multisurfaces for heat exchange from the housing to the circulating fluid.

6. The fluid air motor of claim 1, 2, 4, or 5 wherein the interior of the liner has a plurality of radially outwardly disposed transversely crescent shaped segments.

7. The fluid air motor of claim 6 wherein the interior of the liner is elliptical forming two chambers in the motor.

8. The fluid air motor of claim 3 wherein the annular inlet chambers and annular outlet chambers are defined by interior walls of the housing which provide multisurfaces for heat exchange from the housing to the circulating fluid.

9. The fluid air motor of claim 3 or 8 wherein the walls are transverse to the longitudinal axis of the rotor and in supportive contact with the exterior of said liner.

10. The fluid air motor of claim 3, 8, or 9 wherein the interior of the liner has a plurality of radially outwardly disposed transversely crescent shaped segments.

11. The fluid air motor of claim 10 wherein the interior of the liner is elliptical forming two chambers in the motor.

* * * * *